US005894781A

United States Patent [19]

Kuvshinov

[11] Patent Number: 5,894,781

[45] Date of Patent: Apr. 20, 1999

[54] HYDRAULIC HAMMER

[75] Inventor: Viktor Alexandrovich Kuvshinov, Novosibirsk, Russian Federation

[73] Assignee: Aktsionernoe Obschestvo Zakrytogo Tipa "Rossiiskaya Patentovannaya Tekhnika" Aozt Ropat, Novosibirsk, Russian Federation

[21] Appl. No.: 08/908,015

[22] Filed: Aug. 11, 1997

[30] Foreign Application Priority Data

Aug. 14, 1996 [RU] Russian Federation ..... 96116740

[51] Int. Cl.[6] ..... F01L 15/14

[52] U.S. Cl. ..... 91/246; 91/271; 91/281; 91/336

[58] Field of Search ..... 91/458, 217, 246, 91/265, 281, 271, 335, 336; 173/90, 112, 200

[56] References Cited

U.S. PATENT DOCUMENTS

| | | | |
|---|---|---|---|
| 2,789,540 | 4/1957 | Kupka et al. | 91/271 X |
| 3,464,315 | 9/1969 | Weyer | 91/271 X |
| 3,774,502 | 11/1973 | Arndt | 91/246 |
| 3,815,472 | 6/1974 | Schantz | 91/281 X |
| 4,825,960 | 5/1989 | Krone | 91/281 X |

FOREIGN PATENT DOCUMENTS

| | | |
|---|---|---|
| 2654219 | 6/1978 | Germany . |
| 2708512 | 8/1978 | Germany . |
| 2900221 | 7/1980 | Germany . |

*Primary Examiner*—Hoang Nguyen
*Attorney, Agent, or Firm*—Ladas & Parry

[57] ABSTRACT

A hydraulic hammer for driving a pile into soil in which an impact weight is arranged for being driven with reciprocating motion along guideways in a casing by a double-acting hydraulic cylinder. A pump having a drain line and a pressure line is connected to drive a piston in the hydraulic cylinder. Two two-position valves connect a piston cavity of the hydraulic cylinder with the pressure line or the drain line of the pump. Each valve has a valving element whose front axial end bears against a seat along an annular contact surface when the valve is closed. The valves carry at their rear axial ends control pistons, each of which has a diameter smaller than the diameter of the contact surface of the valving element with the seat. The two valves are coaxially arranged in opposition to one another and control communication between the hydraulic cylinder and the pressure or drain lines of the pump. Each valving element is in the form of a cylinder sealingly accommodated in a valve body along its outer diameter, the size of which is close to the diameter of the contact surface of the valving element. A cavity located at the front axial end of one valving element is communicated with a cavity located at the rear axial end of the other valving element.

4 Claims, 2 Drawing Sheets

HYDRAULIC HAMMER

THE FIELD OF APPLICATION OF THE INVENTION

The present invention relates to building machines intended for driving into the soil piles, sheet piles, pipes and other structural elements.

BACKGROUND FOR DEVELOPMENT OF THE INVENTION

Known in the prior art is a hydraulic apparatus for driving piles (Cf. FRG Patent No. 2,900,221; Cl. E 02 D 7/10), comprising a casing, an impact weight secured on the casing, a hydraulic cylinder housing a pressure-applying piston whose rod is connected with the impact weight, and a hydraulic distributor accomodated in the hydraulic cylinder and constituted by an assembly including a distributing slide valve with a plunger capable of cooperating with the axial-end surface of the power piston. The slide valve and the plunger form a closed volume (a control cylinder) communicating with the space housing the piston, the stroke of which is limited by a stop member. The control cylinder is connected with a drain outlet via a safety valve. The above-cited apparatus is operative and is put into practice, but it suffers from two disadvantages, namely: a high cost because of the need to use a slide valve-type hydraulic control system, and of the need for a precision machining. Besides, hydraulic losses experienced during reversal account for up to 20% of energy of the entire operating cycle due to the so-called "short-circuiting" of the slide valve.

Also known in the prior art is a technical solution in accordance with FRG Patent No. 2,708,512 (E 02 D 7/10) that comes nearest to the present invention and is directed to a pile driving hydraulic hammer comprising a casing, an impact weight mounted so as to be capable of performing a reciprocating motion in relation to the casing, a double-action hydraulic cylinder mounted on the casing and having a piston rod dividing the interior of the hydraulic cylinder into, two cavities, viz. a rod cavity facing a pile, and a piston cavity on the other side of the piston, the piston rod being connected with the impact weight. The above-cited hammer further comprises a pump, a drain-pipe line, a pressure pipe line in permanent communication with the rod cavity, two two-position valves disposed in valve bodies and adapted to alternately put the piston cavity in communication with either the pressure line, or the drain line. These valves are manufactured in accordance with FRG Patent No. 2,654,219 (F 15 B 13/042) in such a manner that each valve would have two control pistons, the diameters of which are smaller than the working diameter of the valve seat. With this structural arrangement of the valves, during their reversal, first an open valve gets closed under the effect of the control piston, while a closed valve gets opened only after equalization of pressure, in the piston cavity and in the pressure line or in the drain one.

The main limitation inherent in the latter-cited hammer resides in the fact that its closed valve is unreliably actuated at the end of an idle stroke, i.e. when the piston and impact weight move upwards. The point is that during an idle stroke an open valve puts the piston cavity in communication with the drain line, while a closed valve separates, the piston cavity the pressure line and, consequently, is blocked in its closed position by the working pressure equal to that in the pressure line. After closure of the open valve, the piston cavity becomes closed and pressure therein is increased only due to kinetic energy of the impact weight which continues to move upwards by inertia until it is, arrested by the braking effect of the impact weight, friction and of the hydraulic force exerted onto the piston in the piston cavity. Thus, to enable the closed valve to get opened, pressure in the piston cavity must reach the working pressure value, i.e. to become equal to that in the pressure line. However, this condition is not always observed, and then the piston and impact weight hang up in their upper position and no working stroke takes place. The reason of this hang-up resides in the fact that frequently kinetic energy of the piston and impact weight proves to be insufficient to build up within the piston cavity a pressure having a required value. For instance, when a hammer is operated not at its full, but only at its partial energy, its stroke is not big and, consequently, its velocity is low. In up-to-date hydraulic hammers operated with a full stroke, their impact weight at the end of an idle stroke is accelerated up to approximately 1.8 m/sec, whereas in operation with minimum blow energy this value is only about 0.3 m/sec, that is in these two cases the kinetic energy of the impact weight this energy is proportional to the square of velocity) differs by 36 times. Besides, a pressure rise in the piston cavity at the end of an idle stroke due to the braking effect of the impact weight is also slowed down by imprevisible leaks from the piston cavity and by the presence of air in the working fluid. This disadvantage of the prior-art hammer is confirmed not only by appropriate calculations of the working process, but also by our own experience: in the hammers we have developed valves were used of a type similar to the described valves and we had to give up, since all our attempts failed to eliminate constant hangs-up of the piston and impact weight in their upper position.

The above-cited hydraulic hammer has yet other drawbacks. For instance, at the end of its working stroke, a valve is first closed through which the piston cavity is put in communication with the pressure line. At the end the valve's stroke, when the slit between the valve and its seat becomes narrow, while its hydraulic resistance becomes, accordingly, great, a working pressure acts upon nearly the entire cross-sectional surface area of the valve (substracting only the control piston surface area), while the backpressure onto the valve from the side of the piston cavity becomes insignificant because of the throttling effect of the slit. As a result, a valve having a weight of the order of 1 kg is accelerated with an effort reaching several tons up to a high velocity and breaks down at it contacts the seat. Since the valve-accelerating pressure acts upon the valve over a great surface area, it is necessary, to effectively brake it, to provide a hydraulic brake with a chamber whose diameter would be comparable to that of the seat, thereby greatly complicating the structure.

BRIEF DESCRIPTION OF THE INVENTION

It is the object of the present invention to improve reliability of the hammer during operation over the entire working range of blow energy values.

The above-formulated object is accomplished by the fact that the hammer according to the invention comprises a casing, an impact weight arranged for a reciprocating motion in relation to the easing, a double-action hydraulic cylinder adapted to move the impact weight, mounted on the casing and having a piston with a rod disposed in such a manner as to form within the interior of the hydraulic cylinder a rod cavity facing a pile, and a piston cavity disposed on the other side of the piston, the rod being connected with the impact weight; a pump having a drain pipe line and a pressure pipe line permanently communicated with the rod cavity of the hydraulic cylinder; two two-position valves adapted to connect the piston cavity of the hydraulic cylinder with said pressure or drain lines. With this arrangement, each valve has, as it is closed with its seat, a contact surface in the form of a narrow ring disposed on the frontal axial end of the valve facing the seat and comprises two control pistons, each of which has a diameter that is smaller than the diameter of the contact surface of the valve, the control cavities of the pistons being able to communicate with both the pressure or drain lines via control lines. Each valve in accordance with the present invention is made in the form of a cylinder accomodated and packed in the valve body along its outer diameter, the dimension of which is close to the diameter of the contact surface of the valve. The cavity on the side of the front axial end of the valve is communicated with the cavity on the side of the rear axial end of the valve lying opposite to its seat.

Owing to the fact that the cavities of either side of each valve are intercommunicated, fluid pressure in these cavities is equalized and, during reversal, both valves start moving simultaneously only under the effect of the control pistons. This fact ensures an absolutely reliable reversal of the valves with any operating mode of the hammer, and also permits to employ small-diameter control pistons as compared with the diameter of the contact surface of the valve. The intercommunication of the compartments located on the sides of the front and rear axial ends of the valve can be realized in the form of a channel formed in the valve.

It is advisable that the channel adapted to intercommunicate said cavities disposed on either side of the axial ends of the valve, would also accomodate, arranged in parallel to each other, a throttle valve and a check (non-return) valve, the fluid flow direction being from the front axial end of the valve towards the rear one. This specific inventive feature makes it possible to regulate the movement velocity of each valve during reversal and, in this manner, to practically eliminate any "short circuit" effect. As the valve is closed, the working fluid flows out in the direction from the front axial end towards the rear one through openings made in both the throttle and in the valve. As a result,an arising hydrodynamic pressure difference braking the valve is weaker at its axial ends and, accordingly, the valve movement velocity is higher. As the valve gets opened, the fluid flow-out takes place in the direction from the rear axial end towards its front axial end only through the openings formed in the throttle valve, thereby, accordingly, enhancing the hydrodynamic pressure difference effect at the axial ends of the valve. This effect brakes the valve movement and, as a result, the valve velocity becomes lower than during its closure.

The control pistons of each valve can be arranged on the side of the rear axial end of the valve and may have different diameters. With this arrangement, the valves can be disposed with their front axial ends lying opposite each other, while the cavities on the side of the front axial ends of the valves can be intercommunicated and also communicated with the piston cavity of the hydraulic cylinder, thereby improving the compactness and general engineering adaptability of the structural arrangement of the valves.

With this approach, the primary main advantage of the present invention resides in the fact that each valve is unloaded from the effect of the axial force exerted by the hydraulic pressure upon its axial ends, since the surface areas of its axial ends are close to each other in terms of their sizes, and pressures acting upon its axial ends are also close to each other in terms of their values because of the fact that the cavities on both sides of the valve are intercommunicated. This approach makes it possible to reverse the valves with absolute reliability with any operating modes of the hammer, only by acting by the control pistons.

A second important advantage of the proposed invention resides in the fact that the movement velocities of the valves during reversal can be set at their optimum values by arranging a throttle valve and a check valve, acting both of them in parallel, in the channels communicating the cavities on the side of the axial ends of each valve. With this approach, as the valve gets opened, the fluid outflow in the direction from the rear axial end towards the front axial end of the valve takes place only through the opening made in the throttle and, as a result, the valve opens slowly.

As the valve gets closed, the fluid outflow in the direction from the front axial end towards the rear one takes place through the throttle and the check valve, i.e. through openings having a greater total surface area. As a result, the degree of throttling becomes lower, while the valve movement velocity higher than during its closure. In this manner, during reversal of the valve, the closure time of one valve is always shorter than the opening time of the other valve and, therefore, leaks during a "short circuit" of the valves are negligibly small (less than 1% of the cycle energy).

BRIEF DESCRIPTION OF THE DRAWINGS

The objects and advantages of the present invention will be better understood with the help of the following drawings illustrating its embodiments.

DETAILED DESCRIPTION OF THE PREFERRED EMBODIMENTS OF THE INVENTION

Figure 1:
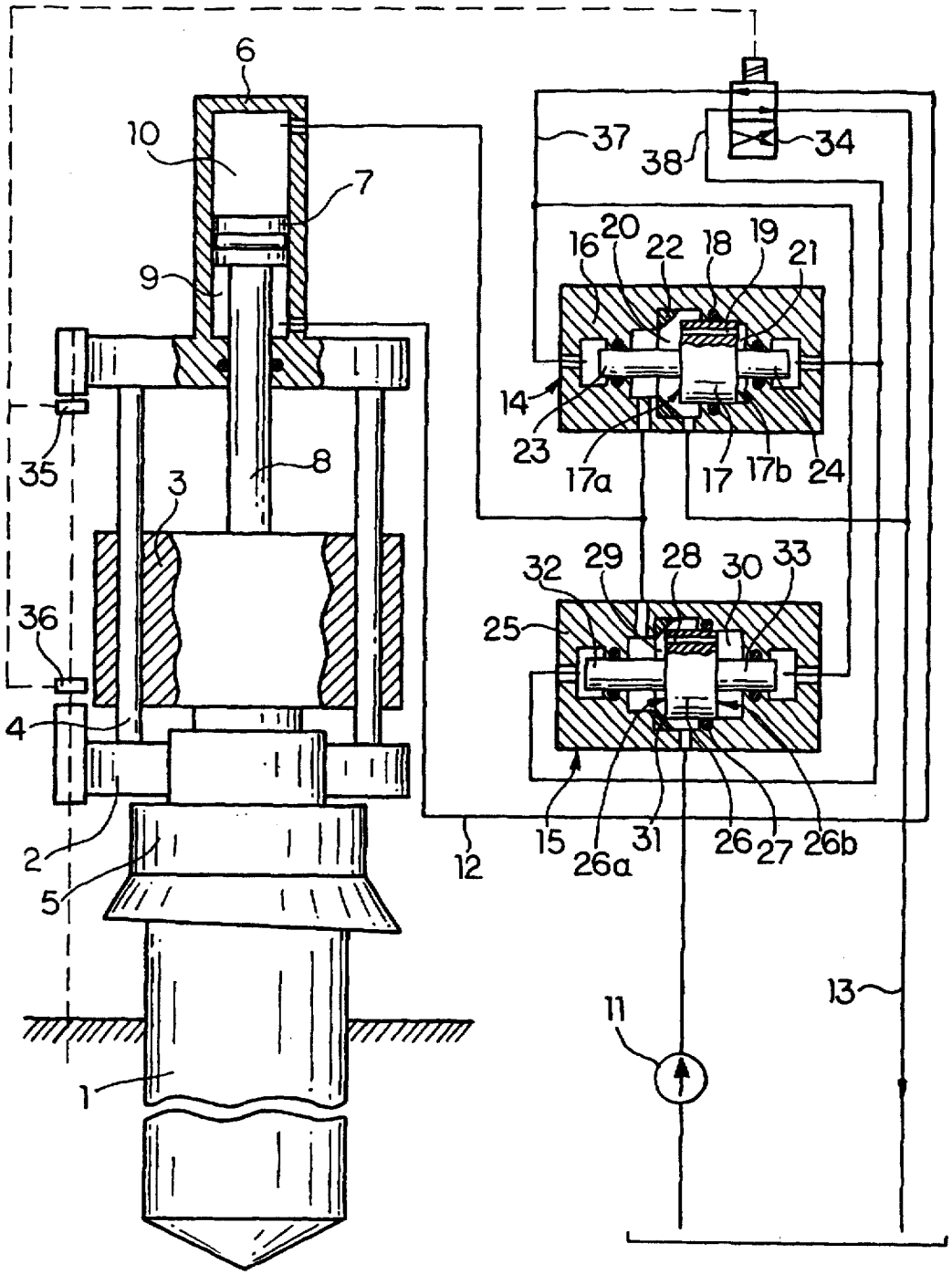
FIG. 1 represents a hammer in accordance with the invention, in its initial position, in a longitudinal sectional view.

FIG. 1 illustrates a hammer in accordance with the invention. It is intended for driving into the soil various soil-compacting elements, such as a pile 1. The hammer comprises a casing 2, an impact weight 3 mounted for reciprocating motion along guideways 4 of the casing 2, a pile cap 5 interposed between the impact weight 3 and the pile 1, a double-action hydraulic cylinder 6 adapted to move the impact weight 3, secured on the casing 2 and having a piston 7 with a rod 8 which form in the hydraulic cylinder 6 a cavity 9 facing the pile 1, and a piston cavity 10 disposed on the other side of the piston 7, the rod 8 being connected with the impact weight 3. The hammer further comprises a pump 11, a pressure line 12 permanently communicated with the rod cavity 9, a drain line 13, and two two-position valves 14 and 15. The valve 14 comprises a body 16, a valving element 17, a seal 18 for the valving element 17 in the valve body 16, a channel 19 formed in the valving element 17 and adapted to put a cavity 20 on the side of the front axial end **17*a* in communication with a cavity 21 on the side of the rear axial end 17*b* of the valving element 17, a valve seat 22, and control pistons 23 and 14. Accordingly, the valve 15 comprises a body 25, a valving element 26, a seal 27, a channel 28 formed in the valving element 26 for communicating a cavity 29 on the side of a front axial end 26*a* with a cavity 30 on the side of a rear axial end 26*b* of the valving element 26, a seat 31 of the valve 15, and control pistons 32 and 33. The valves 14 and 15 are controlled by a two-position slide valve 34 which is reversed in response to signals issued by position sensors 35 and 36 of the impact weight 3, and which has control lines 37 and 38**.

Figure 2:
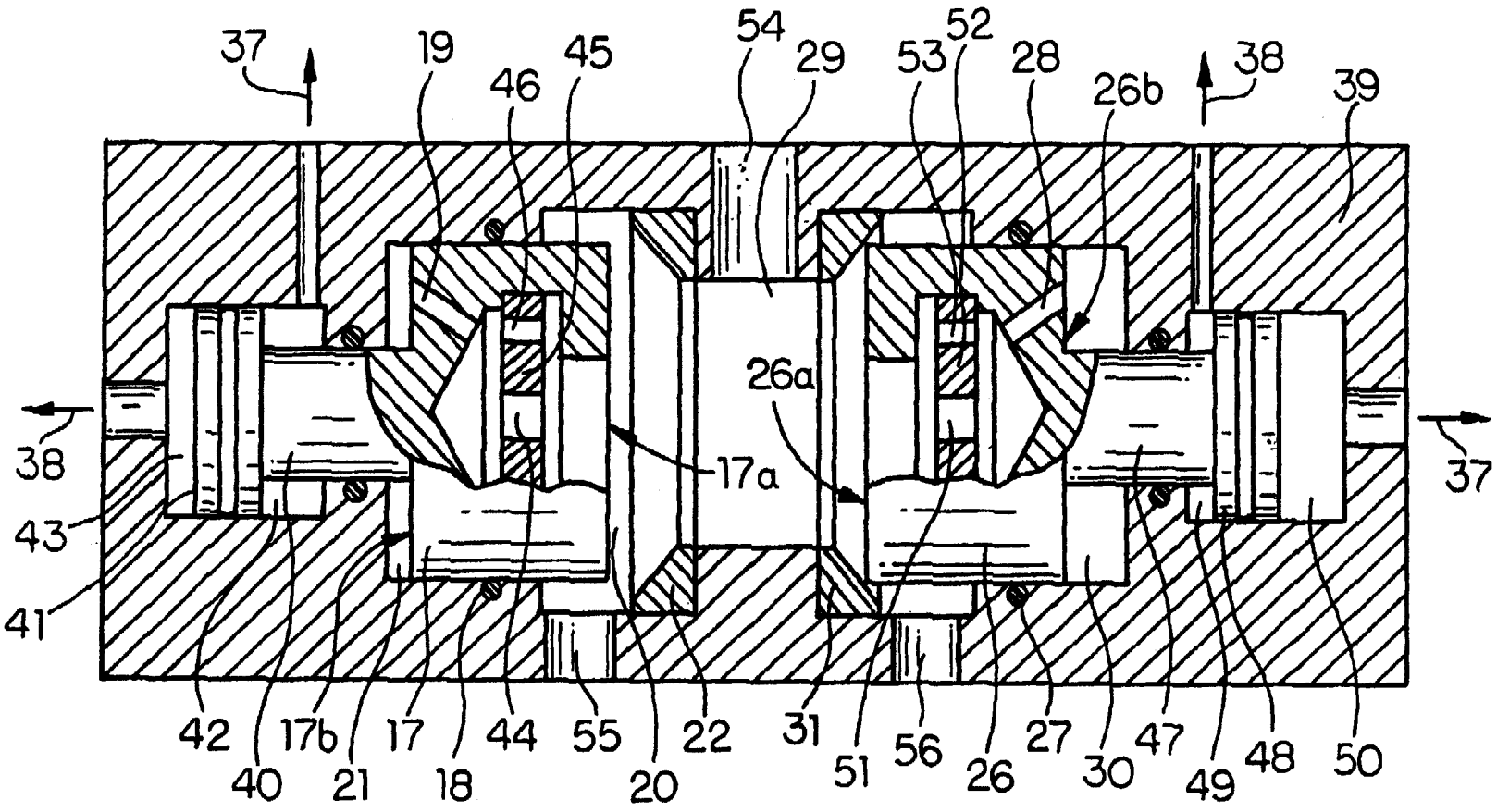
FIG. 2 represents a longitudinal sectional view of two two-position valves adapted to control operation of the hydraulic cylinder of the hammer in accordance with the invention.

FIG. 2 represents a sectional view of one embodiment of a two-position valve. A one-piece body 39 houses two valving elements 17 and 26 packed by seals 18 and 27. The valving element 17 is provided on the side of a rear axial end 17*b* with control pistons 40 and 41 having control cavities 42 and 43. The cavity 20 on the side of the front axial end 17*a* of the valving element 17 and the cavity 21 on the side of the rear axial end 17*b* of the valving element 17 are intercommunicated through a channel 19 accommodating a throttle valve 44 formed in a check valve 45 with openings 46. Accordingly, the valving element 26 is provided with control pistons 47 and 48 forming control cavities 49 and 50, and with a throttle valve 51 and a check valve 52 having openings 53. As seen in FIG. 2, in the embodiment having a one-piece body 39, the cavities 20 and 29 of both valving elements constitute a single cavity on the side of the front axial ends, and this cavity communicates via an opening 54 with the piston cavity 10 of the hydraulic cylinder 6, an opening 55 being communicated with the drain line 13, and an opening 56 being communicated with the pressure line 12.

The hydraulic hammer is operated in the following manner:

In its initial position (FIG. 1), the control slide valve 34 is found in the position shown in the drawing in response to a signal from the sensor 36, and fluid forced by pressure exerted by the pressure line 12 flows, via the slide valve 34, along the control line 37 into the control cavities, as shown in FIG. 1, acting upon the control pistons 23 and 33 and tending to open the valving element 17 and to close the valving element 26. With this, the opposite lying control pistons 24 and 32 are relieved of pressure, since their cavities are connected via the control line 38 with the drain line 13. The axial ends 17*a* and 17*b* of the valving element 17 are subjected to the effect of equally dimensioned, but oppositely directed hydrostatic pressure forces which are mutually equilibrated, since both the surface areas of the axial ends of the valve, and pressures in the cavities 20 and 21 are equal. Similarly, the valving element 26 is relieved of the effect of an axial hydraulic force too. Consequently, each valve is exposed only to the force of pressure exerted by the control pistons 23 and 33, respectively, under the effect of which the valving element 17 is open, and the valving element 20 is closed.

As the impact weight 3 occupies its upper position, a signal issued by the sensor 35 switches over the control slide valve 34 to its second position, in which the control line 37 is connected with the drain line 13, while the control line 38 is connected with the pressure line 12. In this position, the control pistons 24 and 32 are subjected to the effect of a working pressure (i.e. of the pressure in the pressure line 12), whereas the pistons 23 and 33 are relieved of any effect of a working pressure, since their cavities are connected with the drain line 13 via the control line 37. At the initial moment of the reversal operation, pressures on the side of the axial ends of each valve are equal and, therefore, the speed-up of each valve will take place with an acceleration $a=F/m$, wherein F is the force equal to the product of the working pressure by the cross-sectional area of the control pistons 24 and 32 of, respectively, the valving elements 17 and 26, m being the valve weight. With increasing velocities of the valves, hydrodynamic resistances in the channels 19 and 28 will increase too and, as a result, the speed-up of the valves will cease so that, further onwards, they will move uniformly until a moment, at which said hydraulic resistance of the openings 19 and 28 will increase to such an extent that the forces equal to the product of the hydrodynamic pressure difference by the surface area of the axial end of each valve will become equilibrated by the forces acting, respectively, from the side of the control pistons 24 and 32.

In the embodiment of FIG. 2, the valving element 17 in its initial position is open under the effect of pressure in the control cavity 42 connected with a control line 37. With this, the force acting to open the valve is equal to a product of a working pressure by the circular surface area of the cavity 42 equal to the difference between the cross-sectional areas of the control pistons 41 and 40. Pressure in the cavities 20 and 21 on both sides of the valving element 17 is the same and equal to the pressure in the discharge line 13, since these cavities are intercommunicated via the channel 19 and the throttle valve 44. The valving element 26 is closed under the effect of the working pressure force acting onto the surface area of the piston 48, since the control cavity 50 is connected with the pressure line 12 via the control channel 37. There is no backpressure in the control cavity 49, since the latter is connected with the drain line 13 via the control line 38. The pressures in the cavities 29 and 30 are the same and equal to pressure in the drain line 13, since these cavities are intercommunicated via the channel 28 and the throttle valve 51. As the impact weight 3 (FIG. 1) reaches its upper position, in response to a signal sent by the sensor 35, the control slide valve is switched over, thereby connecting the control line 37 with the drain line 13, and the control line 38—with the pressure line 12. As a result, a working pressure is established in the cavity 43 (FIG. 2);—this pressure acts upon the piston 41 and generates a force that closes the valving element 17. At the same time, the cavity 42 is connected with the drain line 13 via the control line 37. As the valving element 17 starts moving, the pressure in the cavities 21 and 20 is the same and equal to the pressure in the drain line 13 so that the speed-up of the valve starts with an acceleration determined by the force applied to the piston 41 and by the valve weight, as indicated above. With the increasing velocity of the valve, the fluid flow velocity increases through the channel 19 in the direction from the cavity 20 to the cavity 21 . A hydrodynamic pressure difference arising in the check valve 45 forces the check valve 45 to assume its leftmost position, and shown in FIG. 2, and the fluid outflow takes place through the total cross-sectional area of the throttle 44 and openings 46. In other words, closure of the valve takes place under the effect of a working pressure onto the surface area of the piston 41 (this area is greater than the circular surface area of the cavity 42), while the fluid outflow through the channel 19 takes place though the throttle 44 and the openings 46 arranged in parallel, thereby ensuring a high velocity for closure of the valving element 17. Simultaneously with closure of the valving element 17, the valving element 26 starts opening, but its velocity is lower than that of movement of the valving element 17. This phenomenon is explained by the fact that the valving element 26 gets opened under the action of a working pressure acting upon the circular surface area of the piston 48 in the control cavity 49, i.e. the force opening the valving element 26 is smaller than that acting to close the valving element 17. Moreover, as the valving element 26 gets opened, fluid flows through the channel 28 in the direction from the cavity 30 towards the cavity 29 and presses the check valve 45 in its extreme most left position, in which the openings 53 are closed. As a result, the fluid outflow takes place only through the throttle valve 51 and, because of its small cross-section, the hydrodynamic pressure difference between the cavities 30 and 29 is greater. As a result of the combined effect of these two factors, the uniform movement velocity of the valving element 26 is considerably lower than the closure velocity of the valving element 17, when the hydrodynamic resistance force offered to movement of the valving element 26 is equal to the force acting upon the piston 48 in the cavity 49.

In other words, when the switch-over in the upper position has taken place, the valving element 17 is closed, the valving element 26 is open, and the same pressure reigns in the cavities 21, 20, 29 and 30, which is equal to the working pressure in the pressure line 12. With this arrangement, during the working stroke (i.e. the downward stroke of the impact weight 3), the valves remain blocked in the above-described positions, namely: the valving element 17 is blocked in its closed position by the force exerted by the working pressure onto the difference between the surface areas of the pistons 41 and 40, while the valving element 26 remains blocked in its open position by the force exerted by the working pressure onto the surface area of the piston 48 (equal to the sum total of the circular surface area of the cavity 49 plus the surface area of the piston 47 exposed to the effect of the working pressure from the side of the cavity 29).

As the impact weight 3 assumes its lower position, as stated above, the cavities 50 and 42 are found under the working pressure, while the cavities 49 and 43 are in communication with the drain line 13. With this structural layout, the valving element 26 gets closed at the very beginning of movement under the effect of a force equal to the product of the working pressure in cavity 50 by the surface area of the piston 48, substracting therefrom the force with which the same working pressure acts in the cavity 29 upon the surface area of the piston 47. As the valving element 26 goes on moving, the pressure in the cavity 29 drops as a result of the decreasing surface area of the slit defined by the valving element 26 and the seat 31, as well as a result of the increasing volume of the piston cavity 10 of the hydraulic cylinder 6 because of the downward movement of the piston 7, and, ultimately, the force closing the valving element 26 at the end of its stroke is approximately equal to the product of the working pressure by the surface area of the piston 48.

With this, the fluid flow passing through the channel 28 of the valving element 26 is directed from the cavity 29 into the cavity 30 and forces the check valve 52 to assume its rightmost position, in which the openings 53 are open. As a result, the hydraulic resistance offered to the fluid flow passing through the total surface area of the throttle 51 plus the openings 53 is lower than that offered during opening of the valving element 26 and, accordingly, the latter is closed faster. As to the valving element 17, it is opened more slowly, since the fluid outflow from the cavity 21 into the cavity 20 takes place only through the throttle 44, the check valve 45 being pressed by the fluid flow in its rightmost position and the openings 46 being closed.

Hence, the proposed hydraulic hammer offers considerable advantages. In the first place, the valves in the proposed hammer are relieved from the effect of the hydrostatic force onto the axial end of a valve by automatically equalizing pressures acting upon both axial ends of each valve. This circumstance makes it possible to reverse the valves only by the action of control pistons regardless of the value of pressure acting upon the axial ends of the valves, and their surface areas can be made several times smaller than the axial-end area of a valve. With this approach, both valves start moving simultaneously during reversal. Secondly, the fact of using a throttle and a check valve arranged in parallel in an opening formed in a valve for communicating on its both sides makes it possible to set optimum velocities for movement of valves during reversal; in particular, an open valve gets closed always faster than a closed valve gets opened. This reversal mode of the valves depends neither on the operating mode of a hammer (i.e. whether it administers a blow with full or partial energy), or on the velocity of movement of its impact weight, nor on the value of a pressure acting upon its valves, or on other conditions. For this reason, although a "short circuit" seemingly takes place when the valves start moving simultaneously during reversal, as a matter of fact, it can be disregarded by setting up optimum velocities of movement of the valves. Thus, for instance, in the pile driving MG-type hydraulic hammer we have developed, the full stroke of a valve is 8 mm long; the valves move uniformly at following velocities: an open valve—4 m/sec., a closed one—2 m/sec; the acceleration path is about 0.5 mm; it takes 2.5 msec. to reverse an open valve, and 5 msec. a closed one, losses caused by leaks due to a "short circuit" being less than 1% of the cycle energy.

It should be also noted that the diameters of the control pistons 23, 24, 32 and 33 (FIG. 1) need not be necessarily identical. The diameters of the control pistons 41, 48 and 40, 47 can be different too (FIG. 2).

I claim:

1. A hydraulic hammer for driving into the soil reinforcing elements, comprising:

a casing;

guideways at said casing;

an impact weight arranged for performing a reciprocating motion along said guideways of said casing;

a double-action hydraulic cylinder intended to move said impact weight and mounted on said casing;

a piston of said hydraulic cylinder, adapted to form in the cylinder a piston cavity;

a rod, one end of which is connected with said piston, while its other end is connected with said impact weight to form in said hydraulic cylinder a rod cavity facing a reinforcing element;

a pump having a drain line and a pressure line permanently connected with said rod cavity of said hydraulic cylinder;

two two-position valves adapted to connect said piston cavity of said hydraulic cylinder with said pressure line or said drain line;

a body of each of said two two-position valves;

a valving element of each of said two two-position valves, in the form of a cylinder housed by said body of each of said two two-position valves, having a rear axial end and a front axial end facing a seat, said front axial end being provided with a ring-shaped contact surface adapted to cooperate with said seat and representing a narrow ring, said cylinder being sealed along its outer diameter in said housing, said outer diameter being of a size which is close to the size of said contact surface;

two control pistons connected with said valving element, each piston of said two control pistons having a diameter that is smaller than the diameter of said contact surface;

two control cavities formed in said body of each of said two two-position valves, each of said two control cavities accommodating one of said two control pistons;

control lines;

a cavity located on the side of said front axial end of said valving element and formed in said body of each of said two two-position valves; and a cavity located on the side of said rear axial end of said valving element, formed in said body of each of said two two-position valves and communicated with said cavity located on the side of its front axial end.

2. A hydraulic hammer as claimed in claim 1, comprising:

a through channel formed in said valving element and adapted to communicate said cavity located on the side of said front axial end of the valving element with said cavity located on the side of said rear axial end of the valving element.

3. A hydraulic hammer as claimed in claim 1, comprising:

a throttle accomodated in said channel;

a check valve accomodated in said channel, in parallel to said throttle, and adapted to direct a fluid flow from said front axial end of the valving element towards its rear axial end.

4. A hydraulic hammer as claimed in claim 1, wherein said two control pistons of said valving element are arranged on the side of said rear axial end of said valving element and have diameters of different sizes, while said cavities located on the side of the front axial end of the valving element of one of said two two-position valves is communicated with said cavity located on the side of the axial end of the valving element of the other of said two two-position valves and with said piston cavity of said hydraulic cylinder.

* * * * *